US006402058B2

(12) United States Patent
Kaneko et al.

(10) Patent No.: US 6,402,058 B2
(45) Date of Patent: Jun. 11, 2002

(54) AEROSOL SPRAY GUN

(75) Inventors: Shuzo Kaneko, Kamakura; Shigefumi Hashimoto, Yokohama, both of (JP)

(73) Assignee: Ransburg Industrial Finishing K.K., Kanagawa-Ken (JP)

( * ) Notice: Subject to any disclaimer, the term of this patent is extended or adjusted under 35 U.S.C. 154(b) by 0 days.

(21) Appl. No.: 09/805,462

(22) Filed: Mar. 14, 2001

(30) Foreign Application Priority Data

Mar. 15, 2000 (JP) ..... 2000-072809

(51) Int. Cl.[7] ..... B05B 7/12
(52) U.S. Cl. ..... 239/416.2; 239/413; 239/528
(58) Field of Search ..... 239/407, 408, 239/413, 414, 415, 416.2, 417.5, 526, 527, 528

(56) References Cited

U.S. PATENT DOCUMENTS 1,694,078 A * 12/1928 Mueller ..... 239/415
2,052,362 A * 8/1936 Roselund ..... 239/353
2,971,700 A * 2/1961 Peeps ..... 239/296

* cited by examiner

*Primary Examiner*—William C. Doerrler
*Assistant Examiner*—Christopher Kim
(74) *Attorney, Agent, or Firm*—Lowe Hauptman Gilman & Berner, LLP

(57) ABSTRACT

An aerosol spray gun used selectively in two spraying modes of small and large patterns is provided. The aerosol spray gun has a throttle valve, an air duct, and a coupling link. The throttle valve has an internal air duct for supplying pressurized air to a patterning air outlet which shapes a paint spraying stream jetted out from the aerosol spray gun, and has a movable valve element to which a compressed spring applies force to open the valve. The air duct created at the tip of the movable valve element supplies a small volume of air from the internal air duct to the patterning air outlet while the movable valve element seats on a valve seat. The coupling link, coupling the movable valve element to the trigger, has an elongated hole to disconnect the trigger from the movable valve element without cooperative relation between them from an initial stage where an operator begins to squeeze the trigger to an intermediate stage before the operator fully squeezes the trigger.

5 Claims, 4 Drawing Sheets

AEROSOL SPRAY GUN

BACKGROUND OF THE INVENTION 1. (Field of the Invention)

The present invention relates to an aerosol spay gun used for spraying paint on an object.

2. (Prior Art)

In general, an aerosol spray gun transforms liquid paint into mist or aerosol to jet the aerosol paint stream ahead and directs patterning air to the aerosol paint stream to shape it as desired.

Official Gazette of Japanese Patent Laid-Open No. H2-102755 discloses a hand-held aerosol spay gun capable of altering mass of the spraying pattern. Such an aerosol spray gun has an air flow rate regulating valves in air flow paths through which pressurized air is supplied toward a spraying air outlet and a pattering air outlet close to a nozzle of the gun, and the air flow rate regulating valves cooperative with a trigger serves to supply the spraying air outlet and patterning air outlet with air by an amount corresponding to an amount of squeezing of the trigger, or namely, an amount of ejected paint.

More specifically, the air flow rate regulating valves in the air flow paths within the gun are provided with tapered movable valve shafts coupled to the trigger via links and sprung in a direction equivalent to that of closing the valve, and as the movable valve shafts are correlated with the squeezing of the trigger to come apart from valve seats, an amount of air passing through the air flow rate regulating valves increases linearly.

Allowing for the practice that this type of spray guns are typically used by fully squeezing the trigger, a spray gun described in Official Gazette of Japanese Patent Laid-Open No. H2-102755 has a plurality of circumferential grooves in a shaft of a needle valve that determines an amount of ejected paint, and engagement pieces or stoppers are provided being urged toward the circumferential grooves by means of spring force.

Official Gazette of Japanese Patent Laid-Open No. H2-102755 teaches an improvement in which an air flow rate regulating valve has a movable valve shaft to which linkage is relatively altered in its position to regulate relatively between amounts of ejected paint and air, and in such an improved embodiment, an operator can perform such regulation immediately any time during painting operation because of an engagement element screwed down in the movable valve element so as to attach the movable valve shaft to the linkage. Specifically in this arrangement, a rear end of the movable valve shaft is threaded, and the threaded rear end is screwed down in the engagement element (nut) for attachment of the linkage, so that the operator can manipulate the engagement element to regulate an opening degree in the air flow rate regulating valve any time during the painting operation.

As discussed in the Official Gazette of Japanese Patent Laid-Open No. H2-102755, this type of aerosol spray guns do not stop throttling in relation with the trigger in use but do need fully squeeze the trigger in practice. Allowing for this fact, the aerosol spray gun disclosed in the Official Gazette of Japanese Patent Laid-Open No. H2-102755 can be simplified in configuration in various ways.

The inventor of the present application has devised a new invention in the above-mentioned point of view.

Accordingly, it is an object of the present invention to provide a spray gun selectively used in two modes, between small pattern and large pattern, which can be comprised of simple components.

It is another object of the present invention to provide an aerosol spray gun which can be comprised of a reduced number of components compared with the prior art embodiments.

SUMMARY OF THE INVENTION

The present invention provides an aerosol gun, which overcomes technical disadvantages in the prior art as mentioned above and which employs a trigger manipulated by fingers of an operator to regulate an amount of sprayed paint, and the aerosol gun includes:

a throttle valve mechanism that has a movable valve element provided in an internal air duct through which pressurized air is supplied to an outlet of patterning air for shaping aerosol paint stream jetted from the aerosol spray gun;

air hole formed at the tip of the movable valve element for supplying a small amount of air from the internal air duct to the outlet of the patterning air while the movable valve seats on a valve seat; and a coupling means for coupling the movable valve element to the trigger;

the coupling means comprising a disconnecting means for disconnecting cooperative relation of the trigger with the movable valve element from an initial operation step by an operator of starting squeezing the trigger till a step prior to the one where the trigger is fully squeezed.

Thus, in accordance with the present invention, since the cooperative relation between the trigger and the movable valve element is disconnected by the disconnecting means during the steps prior to the one where the trigger is fully squeezed, the movable valve element continually seats on the valve seat while a small amount of air is supplied through the air hole in the movable valve element to the outlet of the patterning air. Thus, during these steps, paint jetted out is small in both amount and pattern, and this results in the paint being sprayed in a small pattern. When the trigger is fully squeezed, however, such movement of the trigger is transmitted to the movable valve element via the coupling means, and the movable valve element is moved away from the valve seat to remain the throttle valve mechanism open, resulting in a large volume of air being supplied to the outlet of the patterning air. Thus, while the trigger is fully squeezed, the paint jetted out is large in both volume and pattern, and this results in the paint being sprayed in a large pattern.

The operator physically feels repelling spring force that is applied to the movable valve element in the course of gradually squeezing the trigger deeper when the spray pattern turns from the small pattern to a larger pattern. Thus, the operator can spray the paint in the small pattern by squeezing the trigger to such an extent of being about to feeling the spring force, and also can switch the paint spray pattern to the large pattern by fully squeezing the trigger of the spray gun.

Other objects and advantages of the present invention will become apparent from preferred embodiments thereof detailed in the following description.

DETAILED DESCRIPTION OF THE PREFFERED EMBODIMENT

Preferred embodiments of the present invention will be described below in detail in conjunction with the accompanying drawings.

Figure 1:
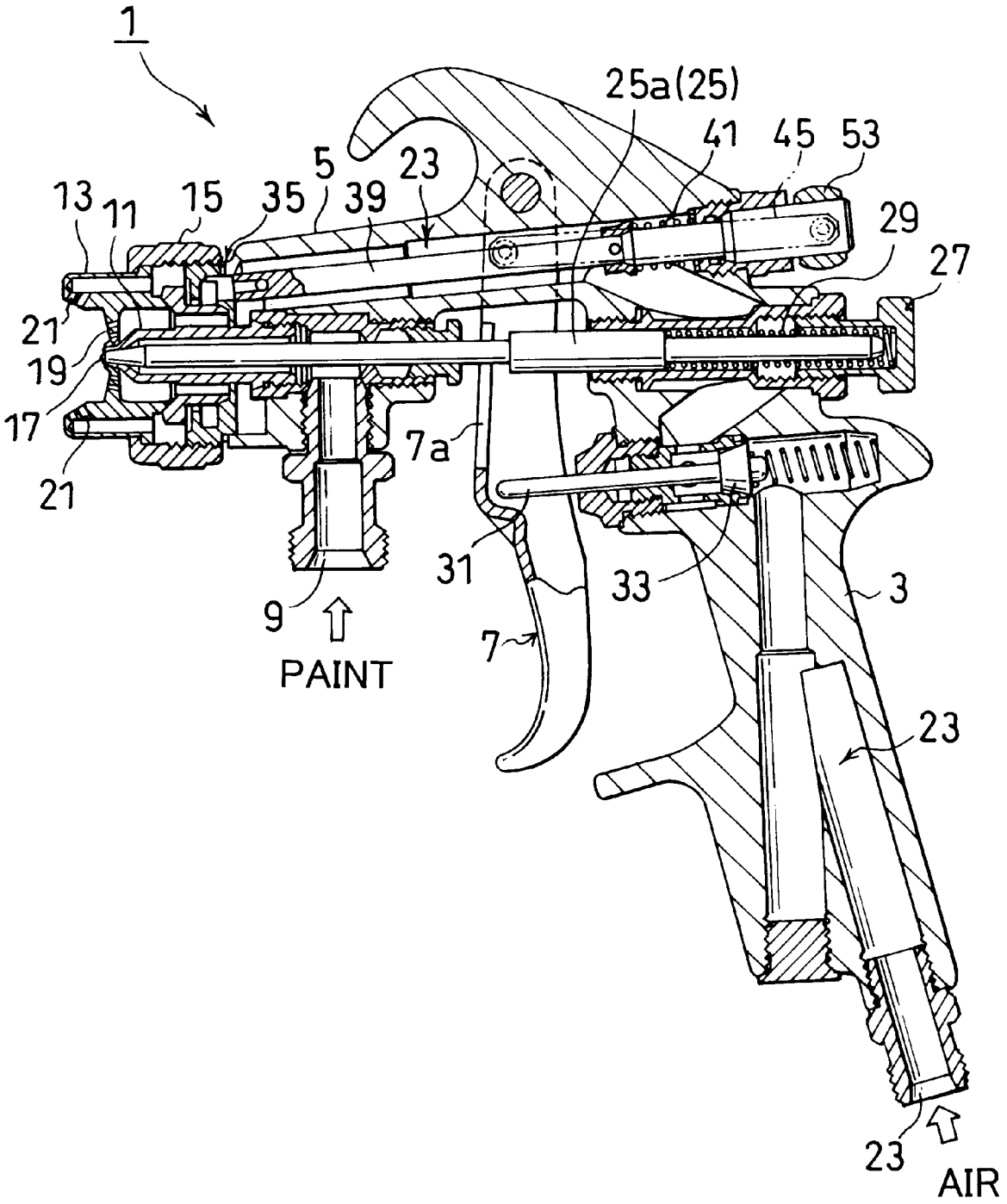
FIG. 1 is a vertical cross-sectional view of an embodiment of an aerosol spray gun of the present invention.

FIG. 1 is a vertical cross sectional view showing an embodiment of an aerosol spray gun. An aerosol spray gun 1 is a hand-held gun outlined as follows: Similar to the prior art, the aerosol spray gun 1 has a handle 3 and a barrel 5, and an operator (not shown), who holds the handle 3, squeezes a trigger 7 so that pain introduced from a paint introducing port 9 in the middle of the barrel 5 can be hit by atomizing air from the tip of the barrel 5 and transformed into mist to be jetted out ahead in a paint spray stream.

The aerosol spray gun 1 will now be further detailed, and the barrel 5 has its tip removably loaded with a paint nozzle 11 and an air cap 13 via a fixture ring 15, both of which make up a spraying head. The paint nozzle 11 has a paint spraying aperture 17 at its center. The air cap 13 is provided with an atomizing air outlet 19 positioned close to the paint spraying aperture 17 in the paint nozzle 11 and a pair of patterning air outlets 21 outwardly positioned from the paint spraying aperture 17 and opposed to each other in radial direction, and air is jetted out through the pair of outlets to the paint spraying stream. The handle 3 has a pressurized air introducing port 23 at its bottom surface, and air introduced through the port 23 into the inside of the handle 3 is transported to the atomizing air outlet 19 and the patterning air outlets 21.

An amount of the paint sprayed from the paint nozzle 11 is determined by displacing the needle valve 25 facing the paint spraying aperture 17. A needle valve 25 extends backward from the paint spraying aperture 17 to the barrel 5 through the trigger 7 and then through the handle 3. A stroke of the needle valve 25 can be regulated by rotating a regulating knob 27 that covers a rear end of the needle valve 25. The needle valve 25 comprises a flare portion 25*a* at its middle section, and is forced to its closing position by compressed spring 29 between a rear end of the flare portion 25*a* and the regulating knob 27.

The trigger 7 has a flange 7*a* which comes in contact and engagement with a front end of the flare portion 25*a* of the needle valve 25 comes, and the flange 7*a* can not engage with the needle valve 25 to move it backward till the trigger 7 is squeezed slightly. As the needle valve 25 is gradually moved backward, the paint spraying aperture 17 relatively increase in its effective opening area gradually (i.e., an amount of ejected paint is gradually increased). Reversely, when the trigger 7 is released, the needle valve 25 is moved forward by repelling force of the compressed spring 29, and thus, the paint spraying aperture 17 reduces its effective opening area gradually (i.e, an amount of sprayed paint is gradually decreased).

Figure 2:
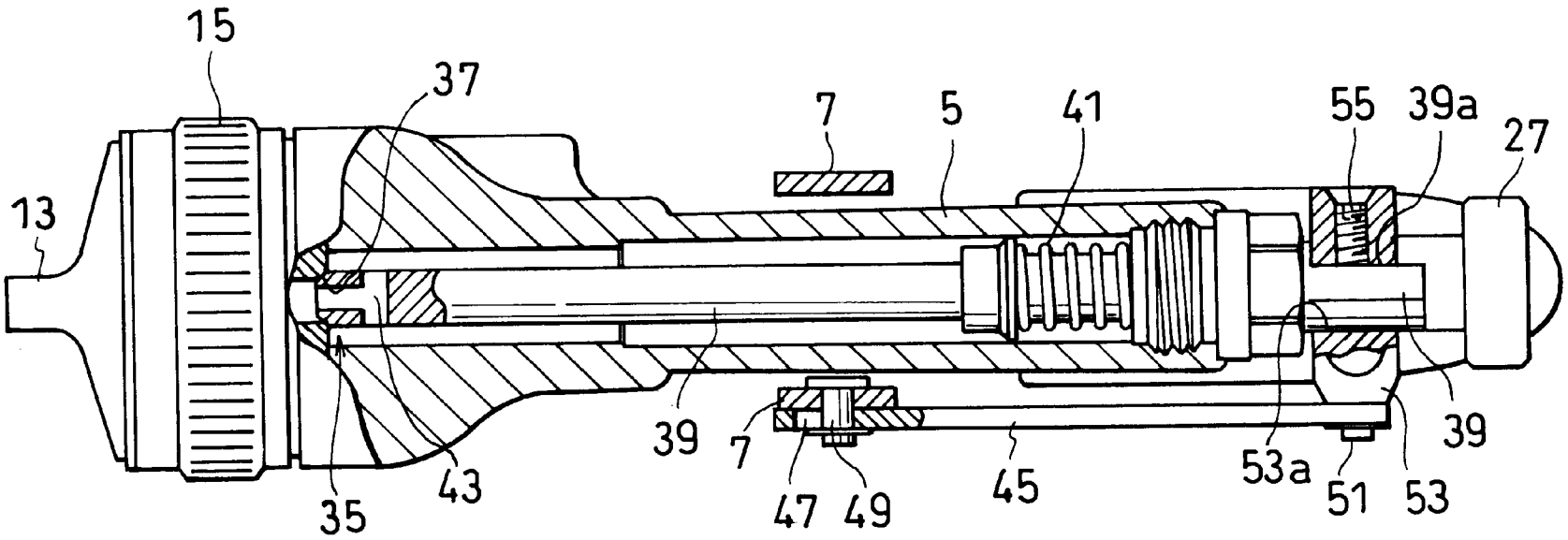
FIG. 2 is a partially cut-out cross-sectional view showing a barrel of the aerosol spray gun in FIG. 1.
Figure 3:
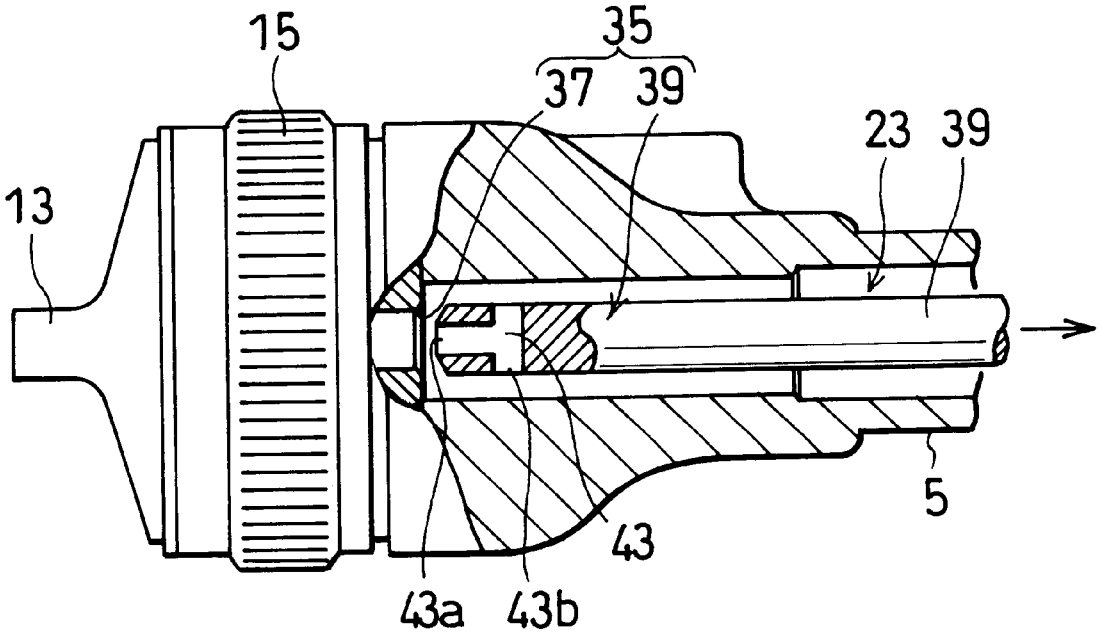
FIG. 3 is an enlarged cross-sectional view showing a main portion extracted from a front section of the barrel in FIG. 2.

The port 23 merging into an internal air duct is provided with a main throttle valve mechanism 33 which is cooperative with the squeezing of the trigger 7 via a pin 31 extending from behind the trigger 7 toward it to open the internal air duct 23. The internal air duct 23 leads to the barrel 5 through the main throttle valve mechanism 33, and further conducts to a second throttle valve mechanism 35 provided immediately upstream the branch of the air duct into the atomizing air outlet 19 and the patterning air outlet 21. The throttle valve mechanism 35, as best seen in FIGS. 2 and 3, includes a valve shaft 39 circular in cross section and serving as a movable valve element which is capable of seating on a valve seat 37, and the valve shaft 39 is positioned in the internal air duct 23 extending through the barrel 5 and is protruded from a rear end of the barrel 5.

The valve shaft 39 is urged to seat on the valve seat 37 by the compressed spring 41 positioned coaxial with a rear end of the valve shaft. The valve 39 has an air hole 43 at its tip. The ventilation hole 43 includes an outlet port 43*a* opening at a leading end of the valve shaft and an inlet port 43*b* opening at circumferential surface of the valve shaft 39 (FIG. 3), and when the valve shaft 39 seats on the valve seat 37, pressurized air passing through the internal air duct 23 within the barrel 5 is introduced to the air hole 43 through the inlet port 43*b* and then is guided through the outlet port 43*a* till it is ejected through the atomizing air outlet 19 and the patterning air outlet 21. As will be recognized in view of the above, an amount of air ejected through the atomizing air outlet 19 and the patterning air outlet 21 depends upon a diameter of the air hole 42 in the valve shaft 39 when the valve 39 seats on the valve seat 37. On the contrary, when the valve shaft 39 is moved apart from the valve seat 37 and a clearance is defined between them, air is transported to the atomizing air outlet 19 and the patterning air outlet 21 through the clearance and the air duct 43.

The valve shaft 39 is coupled to the trigger 7 via a coupling link 45. The coupling link 45 is positioned approximately in parallel with the valve shaft 39 outside the barrel 5, extending from the trigger 7 to the rear end of the valve shaft 39. The coupling link 45 has an elongated hole 17 defined in a longitudinal direction of the coupling link 45, and the coupling link 45 and a trigger 7 are coupled to each other by a fixture pin 49 crossing the elongated hole 47. On the other hand, the coupling link 45 has its rear end pivotally connected about a pin 51 and fixed to a block 53 by the pin. The elongated hole 47 formed in the front end of the coupling link 45 may be created in the rear end of the coupling link 45, and it may be created in both the front and rear ends of the coupling link 45.

The block 53 has a through-hole 53*a* receiving the rear end of the valve shaft 39, and the through-hole 53*a* is shaped in three quarter (¾) of a circle in cross section. The non-circular cross-section of the through-hole 53*a* corresponds to a flat surface 39*a* which is created by partially notching the rear end of the valve shaft 39 circular in cross section. The valve shaft 39*a* of the valve shaft 39 provides a receiving face for a fixture screw 55 radially extending through the block 53. A fixing position of the block 53 relative to the valve shaft 39 can be regulated by unscrewing the fixture screw 55 to moved the block 53 back and fore along an axis of the valve shaft 39 and then screwing the fixture screw 55 tightly. This mechanism of regulating the fixing position of the block 53, which will be understood from the description below, provides a means of timing and terminating a disconnection between the trigger 7 and the coupling link 45 because of the elongated hole 47 intervening therebetween.

Manipulation and operation of the aerosol spray gun 1 will now be described.

Figure 4:
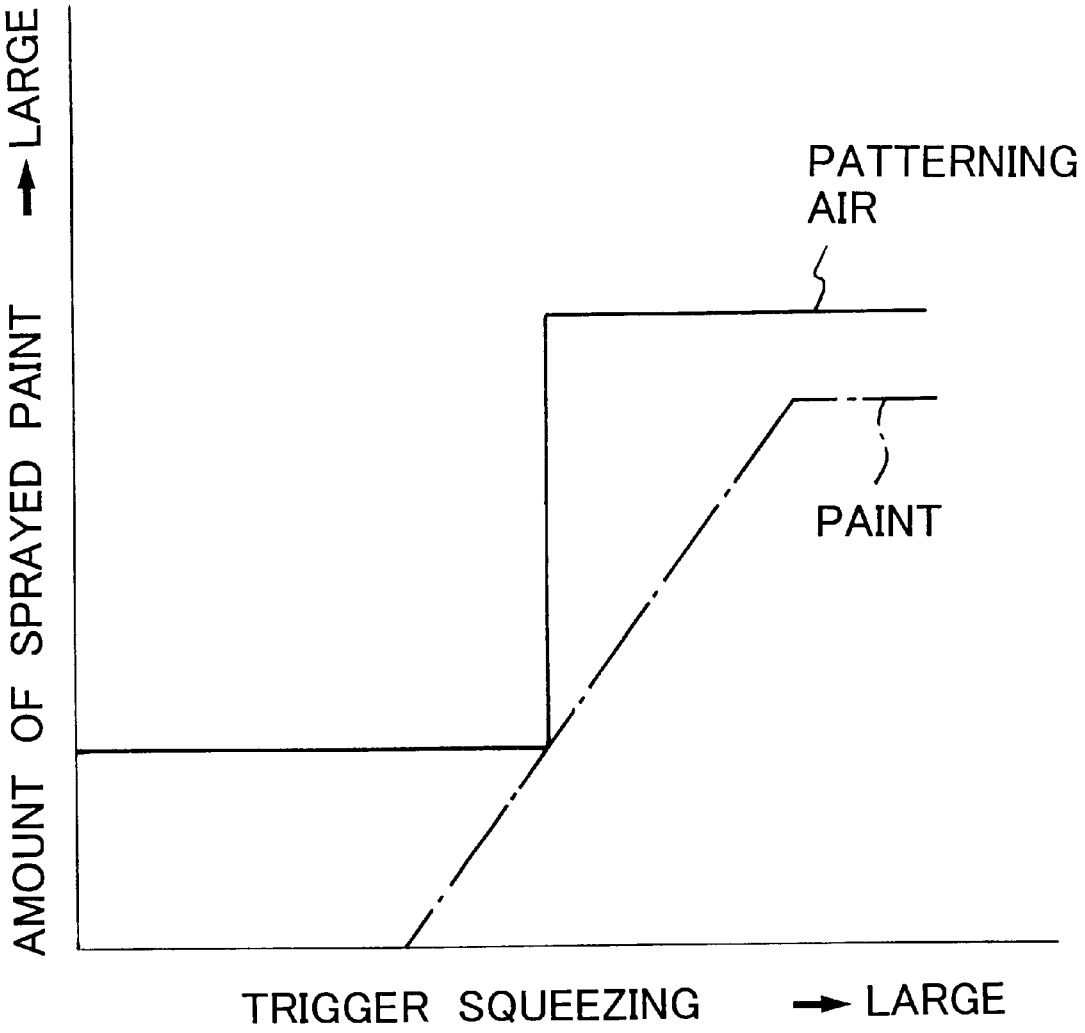
FIG. 4 is a diagram illustrating properties of the embodiment of the aerosol spray gun according to the present invention.

When the operator holds the handle 3 of the spray gun 1 and begins squeezing the trigger 7 after directing a tip of the barrel 5 to an object to paint (not shown), air is merely ejected through the atomizing air outlet 19 and the patterning air outlet 21 and no paint is ejected yet at the initial stage of such operation ( refer to FIG. 4). Specifically, at the initial stage of squeezing the trigger 7, a needle valve 25 controlling an amount of sprayed paint is closed by repelling force of the compressed spring 29 although the main throttle valve mechanism 33 is ready for opening in immediate response to the squeezing of the trigger 7 while the second throttle valve mechanism 35 remain closed, so that air passing through the internal air duct 23 is guided through the air hole 43 in the valve shaft 39 to the atomizing air outlet 19 and the patterning air outlet 21. For convenience of explanation, this stage of the operation is referred to as "idle stage".

When the operator further squeezes the trigger 7, the needle valve 25 begins to open in accordance with an extent of the squeezing, and a volume of paint corresponding to a degree of opening the needle valve 25 is ejected through the paint spraying outlet 17. In such a situation, the elongated hole in the coupling link 45 prevents the squeezing of the trigger 7 from being transmitted to the coupling link 45 to keep the second throttle valve mechanism 35 in the internal air duct 23 still closed (the valve shaft 39 continues to seat on the valve seat 37 because of the repelling force of the compressed spring 41). Specifically, in this state, the trigger 7 and the coupling link 45 are disconnected from each other by the elongate hole 47 and are non-cooperative with each other, the valve 39 does not follow the displacement of the trigger 7 that has been squeezed to such an extent, and the second throttle valve mechanism 35 remains closed. Thus, air passing through the internal air duct 23 is guided through the air hole 43 in the valve shaft 39 to the atomizing air outlet 19 and the patterning air outlet 21. For convenience of explanation, this state is referred to as "small pattern stage".

When the operator further squeezes the trigger 7, the needle valve 25 further opens to eject a larger amount of paint through the paint spraying outlet 17. At such a stage of ejecting a large amount of the paint, the coupling link 45 follows the squeezing the trigger 7 and moves backward while the valve shaft 39 moves backward against the repelling force of the compressed spring 41, so that the second throttle valve mechanism 35 in the internal air duct 23 is opened (the valve shaft 39 is moved apart from the valve seat 37). Thus, air passing through the internal air duct 23 comes out not only through the air hole 43 in the valve shaft 39 but also through the clearance between the valve shaft 39 and the valve seat 37 and a resultant vast stream of air is guided to the atomizing air outlet 19 and the patterning air outlet 21. For convenience of explanation, this state is referred to as "large pattern stage".

As will be recognized from the above description, the operator using the aerosol spray gun 1 physically feels the repelling force of the compressed spring 41 applied to the valve shaft 39 when the second throttle valve mechanism 35 in the internal air duct 23 opens. Specifically, when the second throttle valve mechanism 35 opens, additional force to move the valve shaft 39 backward against the repelling force of the compressed spring 41 is necessary to further squeeze the trigger 7, and hence, the operator learns timing due to force exerted on his or her fingers on the trigger 7.

As can be recognized, the spray gun 1 has the following properties in relation with the force required for squeezing the trigger 7:

(1) An initial displacement of the trigger 7, or a state of transition immediately before an engagement of the flange 7*a* of the trigger 7 with the flare portion 25*a* of the needle valve 25 (Idle Stage), where almost no force is required for manipulating the trigger 7; and (2) A state of disconnection of cooperative relation between the trigger 7 squeezed to a certain extent and the coupling link 45 due to the elongated hole 47 (Small Pattern Stage), where force to move the needle valve 25 (i.e., force against the repelling force of the compressed spring 29 for the needle valve) is required for squeezing the trigger 7.

The spray gun 1 further has the properties as follows:

(3) A state of transmission of the squeezing of the trigger 7 to the valve shaft 39 via the coupling link 45 (Large Pattern Stage), where additional force to move the valve shaft 39 (i.e., force against the repelling force of the compressed spring 41 for the valve shaft) is required for further squeezing the trigger 7.

When the spray gun 1 having the properties as mentioned above is used to paint, the operator relies upon an extent of the force exerted on his or her fingers on the trigger 7 and roughly divided stepwise into Large or Small to selectively paint in two modes.

(1) The operator squeezes the trigger 7 and stops further squeezing right before he or she feels the repelling force of the compressed spring 41 for the valve shaft (Small Pattern Stage).

In such a situation, the pain spraying outlet 17 half opens, and a volume of the paint is ejected corresponding to the degree of opening the half-opened paint spraying outlet 17. On the other hand, the valve shaft 39 seats on the valve seat 37 (the second throttle valve mechanism 35 is closed), and air passing through the internal air duct 23 is guided through the air hole 43 to the atomizing air outlet 19 and the patterning air outlet 21 (Small Pattern Spraying).

(2) The trigger is fully squeezed (Large Pattern Stage).

In this situation, the paint spray outlet 17 is fully opened, and a large volume of the pain is sprayed through the paint spray outlet 17. On the other hand, the valve shaft 39 is moved apart from the valve seat 37 (the second throttle valve mechanism 35 is opened), and air passing through the internal air duct 23 is guided not only through the air hole 43 but through the clearance defined between the valve shaft 39 and the valve seat 37 to the atomizing air outlet 19 and the patterning air outlet 21 (Large Pattern Stage).

In the above-mentioned small pattern spraying mode, a relatively small volume of paint is ejected from the spray gun 1 while a relatively small volume of air is ejected from the atomizing air outlet 19 and the patterning air outlet 21. This mode is suitable for spot painting.

In the above-mentioned large pattern spraying mode, a large volume of the paint is ejected from the spray gun 1 while a large volume of air is ejected through the atomizing air outlet 19 and the patterning air outlet 21. This mode is suitable for painting large dimensions of an object at a time.

Timing upon which the small pattern spraying and the large pattern spraying are switched is determined by regulating a position where the block cooperatively connected to the rear end of the coupling link is to be fixed to the valve shaft 39. This regulation can not be carried out in the course of practically painting with the spray gun 1, but must be performed preliminarily in advance of using the spray gun 1.

An exemplary way of the timing is as follows: After the regulating know 27 is fully turned to close so as to determine a stroke of the needle valve 25, the regulating knob 27 is turned three quarter of a turn to one full turn, for example, to open so as to permit a certain level of the stroke of the needle valve 25, and the, the trigger 7 is squeezed to its upper limit. While keeping such a state (where the trigger 7 is squeezed), the block 53 is moved relative to the valve shaft 39 so that the pin 49 comes in contact with a rear edge of the elongated hole 47 in the coupling link 45, and keeping the state, the block 53 is fixed to the valve shaft 39 (the fixture screw 55 is screwed down therein). Thus, a setting of the timing between the two modes of the small and large pattern sprayings is completed. In practical use of the spray gun 1, the regulating knob 27 is fully opened. In order to facilitate the setting of the timing, the regulating knob 27 has its circumferential surface marked, and the mark is preferably viewed to confirm a revolving amount of the regulating knob 27.

A volume of air in the small pattern spraying mode, or the volume of air supplied through the air duct 43 in the valve shaft 39 to the atomizing air outlet 19 and the patterning air outlet 21 is regulated by using a plurality of valve shafts 39 respectively having the air ducts 43 of different diameters and selecting appropriate one of them to attach it to the spray gun 1.

As has been explained, the operator learns the timing of switching the small pattern spraying mode and the large pattern spraying mode from the repelling force of the compressed spring 41 which urges the valve shaft 39 to open the valve and is felt by the operator on his or her fingers, and if desired, the operator can learn the timing clearer than he or she feels by attaching the compressed spring 41 developing a larger repelling force to the spray gun 1. Alternatively, a plurality of the compressed springs 41 of different levels of repelling force may be used so that the operator, who practically uses and feels the additional repelling force from the spring, may chose suitable one among those compressed springs 41 as he or she desires, to attach the spring to the spray gun 1.

What is claimed is:

1. An aerosol spray gun having a trigger which an operator manipulates to regulate a volume of paint to spray, including a throttle valve mechanism provided in an internal air duct for supplying pressurized air to a patterning air outlet which shapes a paint spraying stream jetted out of the aerosol spray gun, and having a movable valve element urged by spring force to close the valve, an air hole created at the tip of the movable valve element for supplying a small volume of air from the internal air duct to the patterning air outlet while the movable valve element seats on a valve seat, and a coupling means for coupling the movable valve element to the trigger, the coupling means being provided with a means for disconnecting the trigger from a movable valve element without cooperative relation between them from an initial stage of the operation where the operator begins to squeeze the trigger to an intermediate stage before the operator fully squeezes the trigger.

2. An aerosol spray gun according to claim 1, wherein the aerosol spray gun further includes a means of timing and terminating a disconnection of cooperative relation between the trigger and the movable valve element.

3. An aerosol spray gun having a handle held by an operator, a barrel extending forward from the handle, and a trigger manipulated by the operator to regulate a volume of paint to spray, including an internal air duct created in the barrel and extending along the barrel for supplying pressurized air to an outlet through which air is jetted to hit and atomize paint ejected out of an outlet of the barrel, and for supplying pressurized air to an outlet through which patterning air is jetted to hit and shape a paint spray stream developed by the atomizing air, a throttle valve mechanism provided in the internal air duct and having a movable valve shaft which is urged by spring to close the throttle valve mechanism and is configured to extend through the inside of the internal air duct and protrude from a rear end of the barrel, and an elongated hole receiving a coupling pin operative between a coupling link and the trigger, and extending along an extension of the coupling link, the elongated hole is dimensioned to disconnect the trigger from the movable valve shaft without cooperative relation between them from an initial stage where an operator begins to squeeze the trigger to an intermediate stage before the operator fully squeezes the trigger.

4. The aerosol spray gun according to claim 3, wherein the coupling link and the movable valve shaft are coupled to each other via a block which is movable in an axial direction of the movable valve shaft.

5. The aerosol spray gun according to claim 4, wherein the block is fixed to the movable valve shaft by a fixture screw accessible by the operator.

* * * * *